United States Patent [19]

Dinglinger et al.

[11] 3,942,456

[45] Mar. 9, 1976

[54] RESCUE EQUIPMENT FOR SUBMARINE VEHICLES

[75] Inventors: Wolfgang Dinglinger, Oyten; Eckard Rolf, Bremen, both of Germany

[73] Assignee: Erno Raumfahrttechnik, Bremen, Germany

[22] Filed: May 15, 1974

[21] Appl. No.: 470,014

[30] Foreign Application Priority Data

May 16, 1973 Germany ..... 2324709

[52] U.S. Cl. ..... 114/16 E

[51] Int. Cl.[2] ..... B63G 8/24

[58] Field of Search ..... 114/16 R, 16 E, 16.8, 52, 114/125; 9/321, 323, 327; 244/97

[56] References Cited

UNITED STATES PATENTS

| | | | |
|---|---|---|---|
| 964,943 | 7/1910 | Spear | 114/16 R |
| 1,197,650 | 9/1916 | Musorofiti | 114/16.8 |
| 1,815,904 | 7/1931 | Griesbaker | 114/16.8 |
| 2,302,014 | 11/1942 | Fauset et al. | 114/16 R |
| 3,195,493 | 7/1965 | Lacam et al. | 114/16 R |
| 3,520,263 | 7/1970 | Berry et al. | 114/16 E |
| 3,716,009 | 2/1923 | Strickland | 114/16 E |

FOREIGN PATENTS OR APPLICATIONS

| | | | |
|---|---|---|---|
| 25,823 | 4/1906 | Austria | 114/16 E |

OTHER PUBLICATIONS

*Aerospace Vehicle Design*, Vol. I, "Aircraft Design;" 3rd Edition, 1968, p. A140.

*Primary Examiner*—Trygve M. Blix
*Assistant Examiner*—Edward R. Kazenske
*Attorney, Agent, or Firm*—Ralf H. Siegemund

[57] ABSTRACT

A plurality of similarly constructed gas generators are disposed in the ballast tanks of a submarine vehicle, each generator decomposing hydrazine in an emergency gase for developing a particular amount of gas for blowing all or a part of a ballast tank. Each gas generator has a hydrazine reactor, one or two storage containers for hydrazine and either a pump for moving hydrazine to the reactor; or a container filled with driving gas for the same purpose; or both. The number of gas generators triggered depends on the depth of the craft in each instance, and once a generator has been triggered, the development of gas by the generator does not depend on any control, but a triggered generator develops all of the gas it is capable of developing.

12 Claims, 5 Drawing Figures

RESCUE EQUIPMENT FOR SUBMARINE VEHICLES

BACKGROUND OF THE INVENTION

The present invention relates to rescue equipment for submarine crafts, wherein chemical reaction and/or catalytic decomposition of a liquid produces gas which establishes additional static lift (buoyancy) for the craft.

Emergency equipment for submarine vehicles includes, for example, pressurized gas, stored in appropriate bottles and released for expelling the water in the ballast tanks. Of course, if the craft is rather deeply submerged large quantities of gas are needed at a rather rapid rate. However, the valves may ice when the gas is released at too rapid a rate, with catastrophic results. Most importantly, however, one cannot carry just any amount of gas in the craft, because the weight will be too large.

It has been suggested to develop the gas when needed by chemical reaction or by catalytic decompositioning. The equipment and fuel needed here is lighter. Moreover, such reactions are usually exothermic, so that valves will not ice. The disadvantage of the known systems along this line require rather complicated control with regard to amount of gas needed under different circumstances. Particularly, such control requires to provide for more gas the deeper the craft is submerged.

DESCRIPTION OF THE INVENTION

It is an object of the present invention to provide for emergency rescue equipment for submarine crafts which permits ready adaptation to depth.

In accordance with the preferred embodiment of the invention, it is suggested to provide a plurality of individual gas generators, each operating independently from the others and being controlled in the plurality in response to depth of the craft for determining the number of generators operated in each instance, to develop the amount of gas needed for blowing the ballast tanks.

The generators are preferably similar in construction as well as in capacity of gas development, whereby a single unit develops as much gas as needed to surface the craft from the smallest depth. The total number of generators should be at least one more than needed to surface the craft from the lowest controlled diving depth.

The gas generators are preferably located outside of the principle pressure hull of the craft, e.g. inside of the ballast tanks. Generally, if these generators are provided below the water line (for a surfaced vehicle) outside of the pressure hull, they add practically no weight to the craft, because they can be designed, so that their volume equals or nearly equals the volume of displaced water. Another advantageous feature of using self-contained gas generators is to be seen in that they can be exchanged rather easily, and they do not occupy much space. They can be located in the ballast tanks but do not have to be.

In the preferred form of practicing the invention, it is suggested to use hydrazine or a hydrazine derivative and to catalytically decompose that material for gas development. This is particularly advantageous for several reasons. One reason is the capability of a hydrazine reactor to develop large quantities of gas at a relatively high rate. Additionally, hydrazine has almost the same specific weight as ocean water, so that such generators can be installed into already existing submarines without change in controlled volume of the ballast tanks.

Basically, each gas generator is constructed as a three part unit; a storage facility for a chemical to be decomposed; a generator proper which converts the chemical into gas and discharges such gas into a ballast tank of the vehicle to expell water from the tank; and a means for causing the liquid to be forced into and through the generator proper in a manner overcoming the effective gas back pressure as developed in the generator proper.

In a first advantageous construction, the three part unit is contained in a container, which is protected against sea-water corrosion. This container has three separated compartments which are normally separated, one containing a driving gas, the second one a decomposible liquid, e.g. hydrazine, and the third one containing a catalytic reactor for gas generation. The three compartments are normally separated, but communicate in the emergency case so that the driving gas forces the hydrazine into the reactor.

In a second construction hydrazine is contained in a flexible, deformable container, which is directly subjected to sea-water pressure. In the emergency case, a pump pumps the hydrazine into the reactor, whereby the pump needs merely to provide for the pressure differential as between sea-water and reactor chamber pressure, with additional consideration to any pressure loss in ducts, etc.

A third construction is a combination of the two mentioned.

The third variant is of particular interest in that decomposing of hydrazine by pumping this liquid into and through the reactor may be used also as a regular mode of operation for blowing the ballast tanks, while the propelling of hydrazine from an inside container or compartment through a driving gas is used in the emergency, bearing in mind that the pump may not be working.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
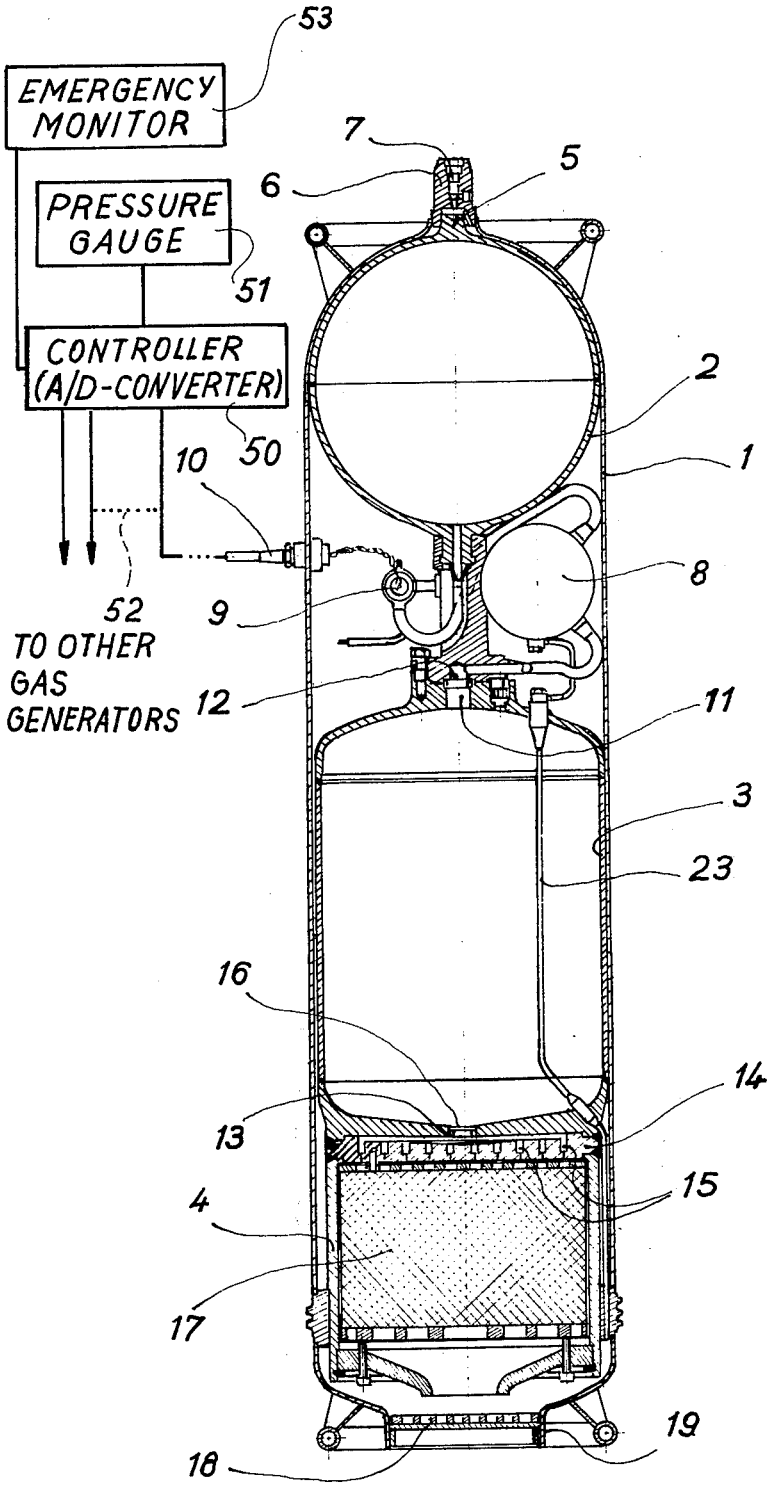
FIG. 1 is a section view of a single unit gas generator as provided within a rescue system shown schematically.

Proceeding now to the detailed description of the drawings, the Figures illustrate a casing 1 made of material resisting chemical reaction with sea water. Casing 1 includes a balloon shaped storage tank 2 for pressurized nitrogen. The amount of nitrogen stored here is small in comparison with the amount of gas to be developed by the particular generator. A filling nipple 5 is sealed by a screw cap 6 and test valve 7. Tank 2 is disposed in the upper portion of casing 1.

A central portion of casing 1 contains a storage tank 3 for the liquid to be chemically decomposed for development of gas, and a gas generating device 4 is positioned in the lower portion of casing 1. The liquid may be hydrazine or a hydrazine derivative and the device 4 may be a catalytic reactor.

The two containers 2 and 3 are interconnected by a pressure regulator 8, whereby a valve 9 is provided between balloon 2 and regulator 8. Valve 9 should be constructed as pyrotechnical valve and is operated electrically via a cable 10.

The storage tank 3 for the liquid has an inlet 11 closed by a burst or rupture disk 12 which breaks under pressure when valve 9 is opened and subjects disk 12 to the pressure of tank 2. The discharge opening 13 of tank 3 is connected to a distributor and aperture disk 14 having a plurality of injection openings 15. A rupture disk 16 is disposed above disk 14 and normally separates the container 3 from generator 4. Disk 16 constitutes the bottom of container 3. Upon distruction of disk 16 under pressure liquid from container 3 is forced into generator 4. However, the normal pressure of the liquid in tank 3 is insufficient to rupture disk 16.

The generator 4 includes a catalytic material 17 which decomposes the liquid injected from tank through openings 15. The pressurized gas once developed will destroy another rupture disk 18 disposed across the bottom opening 19 of casing 1. Upon rupture of disk 18, the gas developed by generator 4 can be discharged through opening 19. If the gas generator is disposed directly inside of a ballast tank, no further connections are needed, the gas can flow or be forced out of openings 19 directly into the ballast tank to cause removal of water therein.

Generally speaking, casing 1 has three major compartments 2, 3, and 4, which are normally separated but interconnected when the generator is triggered for operation, so that a pressure medium from the first compartment can force decomposable liquid from the second compartment to the third one for generation of gas therein.

In order to take into consideration that the ambient sea water has different pressure for different diving depths, the pressure controller 8 is provided. This pressure controller provides for control operation after disk 18 has burst. A sense line 23 in form of a pressure probe runs from controller 8 to a location near opening 19 to provide a reference value as to pressure. Controller 8 then controls the effective pressure of gas as drawn from balloon 2 and as it will be effective as driving agent for forcing liquid from tank 3 into and through the generator 4. The ambient sea water exerts a certain pressure onto the system through opening 19 once open. The driving pressure for the liquid must overcome that pressure, as well as the back pressure from the gas generator and reactor 4.

Figure 2A:
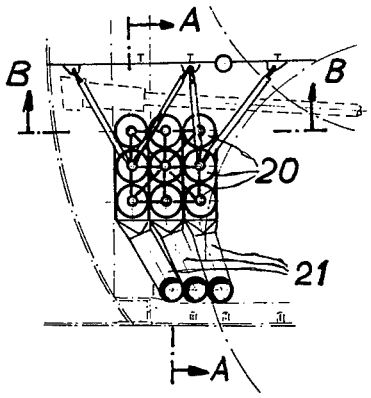
FIG. 2*a* is a top elevation of a plurality of such generators as arranged inside of a diving tank.
Figure 2B:
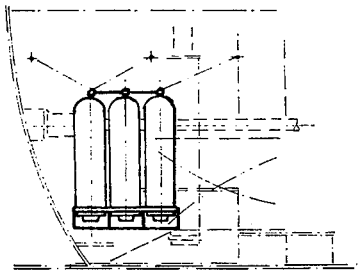
FIG. 2*b* is a section view along line A—A in FIG. 2*a;*
Figure 2C:
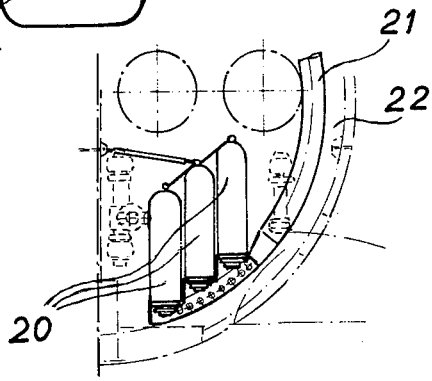
FIG. 2*c* is a section view along line B—B in FIG. 2*b;*.

The multiple arrangement of gas generators in bundles is depicted in FIGS. 2*a*, *b*, *c*. The bottom openings of respective three generators are connected here to a common dischrage pipe 21 which runs the gas as developed in one or several generators to the upper part of ballast tank 22. The ballast tank is open at the bottom, so that gas in the upper part of the tank will force the water out. Each ballast tank of the submarine vehicle may be provided with such a bundle of generators, all of them shown to be of similar size and construction.

Reference numeral 50 denotes schematically the controller for the emergency system as comprised additionally of several gas generators. The controller is not illustrated in great detail, but could be understood, in the broad sense to be an analog-to-digital converter. A pressure gauge 51 or the like provides an electrical signal indicative of depth of the vehicle in any instant. Such an instrument is, of course, already present in the submarine and can be used here for the inventive purpose.

The controller 50 has its input (analog) connected to pressure gauge 51 and provides a digital output representative thereof, in the sense that a number of output lines 52 of the controller 50 become energizable, which number is related to the depth of the craft at that time. The number of lines 52 made energizable in this manner is equal to the number of gas generators needed to develop sufficient buyoncy for surfacing the submarine vehicle. That number is not necessarily linearly related to depth as it depends to some extent on where the gas generators are located.

A circuit 53 is provided to control the emergency case. The circuit is e.g. manually operated when the emergency case arises, and permits the controller to provide electrical signals to those of the lines 52 selected on the basis of the input as applied. In terms of circuitry, the emergency activating device 53 enables the controller outputs, so that a number of the lines 52, corresponding to the measured depth of the craft at that instant will provide signals to the gas generator to which they are connected. All of the lines 52 will receive such energizing signals only when the craft has or is about to reach maximum depth.

These lines are connected to the respective pyrolytic valves 9 in the generators. Whenever the valve 9 of a generator is electrically actuated in that manner, it permits the pressure of the propellant gas in balloon 2 to be applied to the rupture disk 12 in opening 11, breaking the same open so that propellant gas is effective on the liquid in tank 3.

the pressurization of the liquid in tank 3 is effective on disk 16, whereupon the disk ruptures, and liquid is now forced by the propellant gas through openings 15 into and through the catalytic generator 4. The gas as developed rather promptly bursts cover 18 and is discharged into the environment (e.g. pipe 21).

No further control occurs in a regenerator once activated in that manner. The generator will develop the entire amount of gas it is capable of developing, and expells a corresponding amount of water from a ballast tank.

The pressure controller 8 regulates the flow of gas from tank 2 into tank 3 under consideration of the water pressure against which gas generator must work, so that liquid will indeed be forced from tank 3 into the generator 4, at the maximum permissible rate to obtain catalytic development of gas as fast as possible.

As it can be seen, the number of lines 52 energized is strictly related to depth only when the gas generators are all of the same size and develop individually the same amount of gas. However, the generators may differe in size and in this case the digital output as provided by controller 50 must be weighed to reflect the different gas generating capacities. This, however, does not change the principle involved here, namely not to rely on ballast water expulsion by control operation as to the forcing of gas into the ballast tank. Control is provided only as to selection and activation of generators on the basis of the known full gas developing capacity of each generator so activated.

Figure 3:
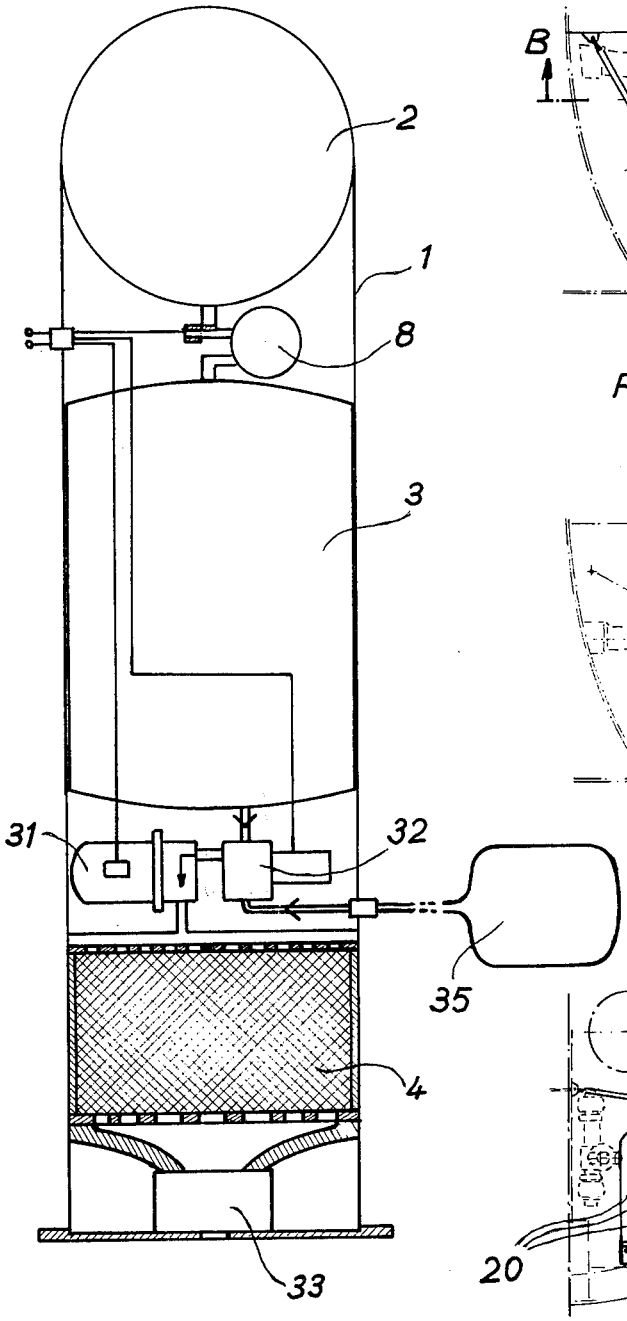
FIG. 3 is a simplified view of a module which is somewhat modified and includes additional equipment for connecting the unit with an external fuel tank.

The embodiment shown in FIG. 3 has all the parts shown in FIG. 1, and is basically of similar construction. There is, however, a relatively small space provided between the bottom of tank 3 and the top of catalytic generator 4; these two parts are not merely separated by a rupture disk. Rather, the connection between the tank and catalytic generator 4 runs through a valve 32, which in a first position establishes a connection between tank 3 and generator 4. This connection may be the normal state of the valve so as to avoid having the connection made dependent on valve operation. The pump is not operating under these conditions.

When the supply of decomposable liquid in tank 3 is exhausted, the valve 32 may change position through an external command, and pump 31 is set into operation. An external, supplemental storage tank 35 may be provided, outside of container 1, holding additional liquid that can be decomposed. The pump 31 will pump that liquid out of tank 35 and force the liquid through the catalytic reactor to continue operation.

In lieu of a rupture disk at the gas discharge opening of the gas generator, a check valve 33 may be provided to permit discharge of gas, but preventing sea water from flushing back into the gas generator.

FIG. 3 is also used to explain another embodiment of the invention. This embodiment assumes, that the container 35 is made of a deformible, collapsible material. As a consequence, the deformible tank 35 is directly exposed to the pressure of the surrounding sea water, but valve 32 blocks normally the passage of liquid from tank 35 to the catalytic generator 4. After exhaustion of the supply in tank 3 or if valve 9 fails to obey the command, valve 32 is operated to permit the content of tank 35 to be driven into the generator. The pressure of the surrounding sea water does not suffice to provide the propelling force for driving the liquid in tank 35 into and through the gas generator, because the gas pressure as developed by generator 4 must be overcome in addition to force liquid into the generator. This then is the function of pump 31. Moreover, the pump operates to overcome friction and pressure losses due to flow resistance.

It should be noted that the operational sequence may be reversed here in that normally pump 31 may be provided to force liquid from tank 35 into the generator. Only if the pump or its control circuit fails, a command is given to blow valve 9. Alternatively, the valve 32 may be provided to change connection and to pump also liquid from tank 3 into the generator. Only if the pump is not working for any reason, is valve 9 blown and the gas from balloon 2 forces liquid into the reactor 4.

The tank 35 is directly exposed to the sea-water. Should the tank leak, the liquid will just be discharged into the sea-water. In the case of hydrazine, the liquid is actually rendered harmless, when discharged into and heavily diluted with seawater.

From a certain point of view one can construe a unit as shown in FIG. 3, with supplemental external tank 35, as a construction of two gas generators with shared reaction chamber, and triggering normally involves pump operation. When the external tank 35 has exhausted its supply, the valve 9 may, but does not have to be blown also. Therefore, such a unit can count as two within the purview of digital, depth-responsive control of the emergency equipment.

The invention is not limited to the embodiments described above but all changes and modifications thereof not constituting departures from the spirit and scope of the invention are intended to be included.

We claim:

1. Rescue equipment for a submarine vehicle for blowing ballast tanks, the vehicle having a diving depth measuring device, the rescue equipment comprising a plurality of individual gas generators each constructed for developing a particular amount of gas by chemical reaction or catalytic decompositioning, the generators being located to expell water from the ballast tanks whenever triggered;

control means connected to the depth measuring device and preparing several of the generators for independent but at least approximately concurring operation; but without triggering them, the number of generators prepared for triggering being dependent upon diving depth at the time of an emergency and as determined by the depth measuring device; and means causing said control means to trigger those of the generators which have been prepared by the control means and independently from the preparation for triggering.

2. Equipment as in claim 1, wherein the generator provides catalytic reaction of hydrazine or of a hydrazine derivate.

3. Equipment as in claim 1, wherein the generators are located directly in the ballast tanks of the vehicle.

4. Equipment as in claim 1, wherein the generators are located outside of the pressure hull of the vehicle.

5. Equipment as in claim 1, wherein each generator of the plurality has a container with three compartments, a first one thereof containing a pressure medium, a second one of the compartments being fluid-conductively connected to the first compartment and containing liquid for development of gas, a third one of the compartments being fluid-conductively connected to the second one and containing means for generation of gas, the first, second and third compartments normally being disconnected as to said fluidconducted connections, there being means responsive to triggering of the respective generator by the control means to establish said connections so that the pressure medium of the first compartment forces the liquid in the second compartment through the gas generating means in the third compartment.

6. Equipment as in claim 5, wherein the container is seawater-resistant and disposed in one of the ballast tanks of the vehicle.

7. Equipment as in claim 5, wherein a pressure regulator is interposed to regulate the flow of pressure medium from the first to the second compartment, the regulation being responsive to external seawater pressure.

8. Equipment as in claim 1, a storage container for liquid and being connected to a generator of the plurality, the storage container being constructed so as to subject the liquid therein to the pressure of the surrounding seawater.

9. Equipment as in claim 8, wherein the generator includes a pump for pumping the liquid to and through means in the generator for generating gas.

10. Rescue equipment for a submarine vehicle for blowing a ballast tank, comprising a diving depth measuring device;

a plurality of individual gas generators each generator comprising a storage means for a decomposible liquid;

individual reaction means in each of the generators for decomposing such liquid;

control means being connected to the depth measuring device and preparing a selected number of the generators for independent but at least approximately concurring operation but without triggering said generators, the number of generators prepared for triggering being dependent upon the diving depth at the time of an emergency and as determined by the depth measuring device means operated for causing the liquid of the selected generators to flow into the respective reaction means to obtain decomposing of the liquid and development of a quantity of gas that depends on the selected number of generators discharging the gas as developed into one of the ballast tanks.

11. Equipment as in claim 10, wherein the storage means is a flexible container subjected to seawater, the means for causing being a pump for pumping the liquid into the reactor means.

12. Equipment as in claim 10, wherein the means for causing includes a pressure medium in a container, and means for providing connection between the pressure medium container and the storage means.

* * * * *